US010111539B2

(12) United States Patent
Collette

(10) Patent No.: US 10,111,539 B2
(45) Date of Patent: Oct. 30, 2018

(54) SHELF PARTITION FOR DISPLAYING BAGGED FOOD ITEMS AND METHOD OF USING THE SAME

(71) Applicant: Post Consumer Brands, LLC, Lakeville, MN (US)

(72) Inventor: Stephen Robert Collette, Lakeville, MN (US)

(73) Assignee: POST CONSUMER BRANDS, LLC, Lakeville, MN (US)

( * ) Notice: Subject to any disclaimer, the term of this patent is extended or adjusted under 35 U.S.C. 154(b) by 0 days.

(21) Appl. No.: 15/146,349

(22) Filed: May 4, 2016

(65) Prior Publication Data

US 2017/0318985 A1 Nov. 9, 2017

(51) Int. Cl.

| | |
|---|---|
| ***A47F 5/00*** | (2006.01) |
| ***A47F 5/10*** | (2006.01) |
| ***A47F 7/00*** | (2006.01) |
| ***A47F 7/28*** | (2006.01) |
| ***G09F 3/20*** | (2006.01) |

(52) U.S. Cl.

CPC ..... *A47F 5/005* (2013.01); *A47F 5/105* (2013.01); *A47F 7/0071* (2013.01); *A47F 7/281* (2013.01); *G09F 3/204* (2013.01)

(58) Field of Classification Search

CPC ..... A47F 5/005; A47F 5/105; G09F 3/204

See application file for complete search history.

(56) References Cited

U.S. PATENT DOCUMENTS

| | | | | |
|---|---|---|---|---|
| 487,421 | A | 12/1892 | Lindberg | |
| 551,642 | A | 12/1895 | Kleine | |
| 560,893 | A | 5/1896 | Conant | |
| 1,688,003 | A | 10/1928 | Darby | |
| 1,714,266 | A * | 5/1929 | Johnson | A47L 19/02 211/184 |
| 1,750,576 | A | 3/1930 | Cubberley | |
| 1,919,568 | A | 7/1933 | McCosh | |
| 1,952,749 | A | 3/1934 | Ellis | |
| 2,082,667 | A | 6/1937 | Vanderveld | |
| 2,118,444 | A | 5/1938 | Mueller | |

(Continued)

FOREIGN PATENT DOCUMENTS

| | | |
|---|---|---|
| CN | 3229435 D | 3/2002 |
| CN | 2547230 Y | 4/2003 |

(Continued)

OTHER PUBLICATIONS

Design U.S. Appl. No. 29/560,041, filed Apr. 1, 2016.

(Continued)

*Primary Examiner* — Stanton L Krycinski

(74) *Attorney, Agent, or Firm* — Thompson Coburn LLP

(57) ABSTRACT

A shelf partition for containing and displaying bagged bulk food on point-of-sale shelving has a front panel and an adjustable length side panel. The front panel has at least a translucent front portion. The translucent front portion has a convex outer face adapted to magnify a flat image when the flat image is positioned behind the front portion of the front panel. The adjustable length side panel is connected to the front panel. The front face portion of the front panel and at least a first portion of the side panel are integrally formed as a monolithic and homogenous injection molded piece.

2 Claims, 4 Drawing Sheets

(56) References Cited

U.S. PATENT DOCUMENTS 2,148,681 A * 2/1939 Cameron ..... A47B 88/90 119/322
2,197,789 A 4/1940 Dalton
2,222,974 A 11/1940 Wilson
D150,315 S 7/1948 Richards
2,471,977 A 5/1949 Albert
2,516,122 A 7/1950 Hughes
D163,536 S 6/1951 Morris
2,586,925 A 2/1952 Drengberg
2,658,628 A 11/1953 Hilgen
2,743,774 A 5/1956 Pinto
2,845,188 A 7/1958 Rosenquist
2,872,046 A 2/1959 Polay
2,943,742 A 7/1960 Colley
3,002,632 A 10/1961 George Van
D194,425 S 1/1963 Hungerford
3,117,535 A 1/1964 Hendrickson
D199,794 S 12/1964 Lindley
3,301,408 A 1/1967 Craine
3,304,142 A 2/1967 Rockola
3,308,964 A 3/1967 Pistone
3,329,928 A 7/1967 Broske
3,410,445 A 11/1968 Pilley
3,468,426 A 9/1969 Loewy
3,491,909 A 1/1970 Ikelheimer
3,521,808 A 7/1970 Weiss
3,559,815 A 2/1971 Huddleston
3,592,344 A 7/1971 Schade
3,692,191 A * 9/1972 Moore ..... A47B 57/585 211/184
D234,075 S 1/1975 Clark
D236,935 S 9/1975 Frazelle
3,954,184 A * 5/1976 Mendenhall ..... A47F 5/005 211/184
D241,295 S 9/1976 Entin
D242,198 S 11/1976 Geisler
D246,303 S 11/1977 Davis
D246,304 S 11/1977 Horn
4,111,307 A 9/1978 Peggs
D252,436 S 7/1979 Elliott
4,178,047 A 12/1979 Welch
D267,668 S 1/1983 Rambusch et al.
4,395,955 A 8/1983 Pfeifer
D272,161 S 1/1984 Lodge et al.
D274,491 S 7/1984 Lietzke
D275,921 S 10/1984 Ward
4,491,137 A 1/1985 Jingu
D279,151 S 6/1985 Weiller
4,595,105 A 6/1986 Gold
D285,152 S 8/1986 Smith
4,618,063 A * 10/1986 Mendenhall ..... A47F 5/005 211/184
4,712,694 A 12/1987 Breslow
4,716,841 A 1/1988 Suttles
4,762,235 A 8/1988 Howard et al.
4,765,492 A 8/1988 Howard et al.
4,768,661 A 9/1988 Pfeifer
4,792,051 A 12/1988 Miller
4,858,774 A 8/1989 Winter et al.
D303,458 S 9/1989 Zapf
4,889,253 A 12/1989 Schmulian et al.
4,889,397 A 12/1989 Ryan
D305,582 S 1/1990 Zapf
4,898,354 A * 2/1990 Whittington ..... A47B 57/585 211/175
D306,670 S 3/1990 Pfleuger et al.
4,905,847 A * 3/1990 Hanson ..... A47B 57/58 211/184
D308,394 S 6/1990 Smith
D311,469 S 10/1990 Miller
5,024,336 A 6/1991 Spamer
D318,769 S 8/1991 Marchiony et al.
5,073,428 A 12/1991 Lancelot et al.
D327,190 S 6/1992 Wear et al.
D328,539 S 8/1992 Waterston
5,148,927 A * 9/1992 Gebka ..... A47F 5/005 108/60
D333,934 S 3/1993 Ozawa
D336,933 S 6/1993 Sharon et al.
5,341,945 A 8/1994 Gibson
D351,524 S 10/1994 Belokin, Jr.
5,432,391 A 7/1995 Zawoysky
D365,933 S 1/1996 Spielvogel
D369,700 S 5/1996 Sandy
5,582,305 A * 12/1996 Howell, Sr. ..... A47F 5/0006 211/126.1
D386,335 S 11/1997 LaFreniere
5,682,824 A 11/1997 Visk
5,685,664 A 11/1997 Parham et al.
5,695,077 A 12/1997 Jay
D393,005 S 3/1998 Devito
5,803,276 A * 9/1998 Vogler ..... A47F 5/005 108/60
5,855,281 A * 1/1999 Rabas ..... A47F 5/005 211/175
5,926,315 A * 7/1999 McBride ..... G02B 7/02 235/383
6,041,720 A 3/2000 Hardy
6,073,794 A 6/2000 Bidot
6,142,316 A * 11/2000 Harbour ..... A47F 1/12 211/59.2
6,161,320 A 12/2000 Peterson
6,164,215 A 12/2000 Cook et al.
D436,772 S 1/2001 Soderstrom
D439,084 S 3/2001 Schacht et al.
D443,895 S 6/2001 Pfanner et al.
D445,019 S 7/2001 Vitetta
D445,615 S 7/2001 Burke
6,276,538 B1 * 8/2001 Battaglia ..... A47F 1/12 108/108
6,325,221 B2 * 12/2001 Parham ..... A47F 1/12 211/183
D453,161 S 1/2002 Pentz
6,341,755 B1 * 1/2002 Kump ..... G09F 3/204 248/220.41
D457,737 S 5/2002 Citterio
D458,781 S 6/2002 Cook et al.
D470,684 S 2/2003 Beauregard
6,533,131 B2 * 3/2003 Bada ..... A47B 57/583 211/184
D473,080 S 4/2003 Kellogg
D479,930 S 9/2003 Cook et al.
6,685,037 B1 * 2/2004 Zadak ..... A47B 57/58 108/61
6,691,891 B2 * 2/2004 Maldonado ..... A47F 1/125 211/59.3
D490,103 S 5/2004 Rangel et al.
D494,394 S 8/2004 Leong-Son et al.
D495,172 S 8/2004 Brownfield et al.
D495,539 S 9/2004 Sjoberg
D505,809 S 6/2005 Cassidy et al.
D507,915 S 8/2005 Nagel
D511,060 S 11/2005 Linden
6,991,307 B2 * 1/2006 Hoenig ..... A47B 88/90 211/184
7,066,563 B2 6/2006 Berger
7,083,054 B2 * 8/2006 Squitieri ..... A47F 5/005 211/184
7,163,119 B2 1/2007 Besselman
D551,294 S 9/2007 Goudy
D553,384 S 10/2007 Wilenius
D554,912 S 11/2007 Scicluna et al.
D564,764 S 3/2008 Springer et al.
D566,760 S 4/2008 Cristofaro
D568,645 S 5/2008 Gore et al.
D569,141 S 5/2008 Tobias
D585,215 S 1/2009 Rosenberg
7,478,731 B1 * 1/2009 Mason ..... A47F 1/126 211/59.3
D587,939 S 3/2009 Schloss
D594,313 S 6/2009 Clarke
D596,431 S 7/2009 Berger

(56) References Cited

U.S. PATENT DOCUMENTS

| | | | | |
|---|---|---|---|---|
| 7,703,866 | B2 | 4/2010 | Benz | |
| D615,919 | S | 5/2010 | Bock | |
| D617,125 | S | 6/2010 | Erickson | |
| 7,726,057 | B2 * | 6/2010 | Brinkman | G09F 3/204 248/220.21 |
| D619,393 | S | 7/2010 | Golias et al. | |
| D630,087 | S | 1/2011 | Stram et al. | |
| D635,379 | S | 4/2011 | Klein et al. | |
| D650,596 | S | 12/2011 | Thompson | |
| D651,416 | S | 1/2012 | Martin et al. | |
| 8,096,427 | B2 | 1/2012 | Hardy | |
| 8,113,360 | B2 | 2/2012 | Olson | |
| D657,421 | S | 4/2012 | Yan | |
| D658,497 | S | 5/2012 | Paschke et al. | |
| D661,112 | S | 6/2012 | Grandin et al. | |
| D661,519 | S | 6/2012 | James et al. | |
| D665,196 | S | 8/2012 | Plikat et al. | |
| 8,276,766 | B2 * | 10/2012 | Rataiczak, III | A47F 1/126 211/184 |
| D673,216 | S | 12/2012 | Yuan | |
| D674,216 | S | 1/2013 | Erickson | |
| 8,342,340 | B2 | 1/2013 | Rataiczak, III et al. | |
| D679,329 | S | 4/2013 | Stravitz | |
| 8,454,262 | B2 | 6/2013 | Norman | |
| D690,118 | S | 9/2013 | Grandin et al. | |
| D690,139 | S | 9/2013 | Trinh et al. | |
| D691,402 | S | 10/2013 | Parker | |
| 8,556,092 | B2 * | 10/2013 | Valiulis | A47F 5/005 108/61 |
| D699,990 | S | 2/2014 | Martell et al. | |
| D702,068 | S | 4/2014 | Mitten et al. | |
| D703,744 | S | 4/2014 | Harvey Pennaz et al. | |
| D717,370 | S | 11/2014 | Hammer | |
| D717,573 | S | 11/2014 | Fishman et al. | |
| D723,842 | S | 3/2015 | Walker | |
| D726,256 | S | 4/2015 | Thomson et al. | |
| D726,463 | S | 4/2015 | Andersson | |
| D727,638 | S | 4/2015 | Tsuchiyama et al. | |
| D730,662 | S | 6/2015 | Trinh et al. | |
| 9,090,195 | B2 | 7/2015 | Peters et al. | |
| 9,138,075 | B2 | 9/2015 | Hardy et al. | |
| 9,173,504 | B2 | 11/2015 | Hardy | |
| D754,251 | S | 4/2016 | Bigham et al. | |
| D760,519 | S | 7/2016 | Le | |
| D761,369 | S | 7/2016 | Elsea et al. | |
| 9,392,884 | B2 * | 7/2016 | Juric | A47F 1/126 |
| D766,023 | S | 9/2016 | Coretti, Jr. et al. | |
| D773,219 | S | 12/2016 | Clouse et al. | |
| D776,298 | S | 1/2017 | Melin | |
| 9,538,860 | B2 | 1/2017 | Brej et al. | |
| 9,549,623 | B1 * | 1/2017 | Snell | A47B 88/975 |
| D779,865 | S | 2/2017 | Bram | |
| 9,591,923 | B2 * | 3/2017 | Zeidner | A47B 57/588 |
| D784,746 | S | 4/2017 | Jackson | |
| D784,747 | S | 4/2017 | Jackson | |
| 9,642,475 | B2 * | 5/2017 | Vogler | A47F 1/125 |
| D791,524 | S | 7/2017 | Collette et al. | |
| D792,137 | S | 7/2017 | Collette | |
| 9,723,934 | B2 | 8/2017 | Hardy | |
| D798,091 | S | 9/2017 | Collette | |
| D800,485 | S | 10/2017 | Boni | |
| D803,601 | S | 11/2017 | Schalk et al. | |
| D808,206 | S | 1/2018 | Zeidner et al. | |
| 9,895,007 | B2 | 2/2018 | Hardy | |
| D811,759 | S | 3/2018 | Woods | |
| D814,216 | S | 4/2018 | French et al. | |
| D815,690 | S | 4/2018 | Squillante | |
| 2001/0002659 | A1 | 6/2001 | Bada | |
| 2003/0010737 | A1 | 1/2003 | Lee | |
| 2003/0132178 | A1 * | 7/2003 | Jay | A47B 96/021 211/59.2 |
| 2003/0137227 | A1 | 7/2003 | Hoenig | |
| 2003/0189018 | A1 | 10/2003 | Hopkins et al. | |
| 2004/0011754 | A1 | 1/2004 | Zadak | |
| 2004/0188444 | A1 | 9/2004 | Besselman | |
| 2004/0211739 | A1 | 10/2004 | Lembe | |
| 2005/0150847 | A1 | 7/2005 | Hawkinson | |
| 2005/0178696 | A1 | 8/2005 | Van Diepen | |
| 2006/0049125 | A1 | 3/2006 | Stowell | |
| 2006/0075670 | A1 * | 4/2006 | Brinkman | G09F 3/204 40/666 |
| 2007/0175844 | A1 | 8/2007 | Schneider | |
| 2009/0159763 | A1 | 6/2009 | Kim | |
| 2010/0252519 | A1 | 10/2010 | Hanners et al. | |
| 2011/0174750 | A1 | 7/2011 | Poulokefalos | |
| 2012/0031865 | A1 | 2/2012 | Paeth | |
| 2012/0111764 | A1 * | 5/2012 | Lackey | A47F 5/112 206/736 |
| 2012/0175327 | A1 | 7/2012 | Weiher | |
| 2013/0020270 | A1 | 1/2013 | Valiulis et al. | |
| 2013/0112640 | A1 | 5/2013 | Desmond | |
| 2014/0151313 | A1 | 6/2014 | Breslow et al. | |
| 2014/0210331 | A1 | 7/2014 | Tunzi | |
| 2015/0041418 | A1 * | 2/2015 | Grubbs | A47F 1/126 211/59.3 |
| 2015/0225122 | A1 | 8/2015 | Jones et al. | |
| 2015/0359358 | A1 | 12/2015 | Miller, Jr. et al. | |
| 2016/0029794 | A1 | 2/2016 | Obitts et al. | |
| 2016/0073776 | A1 | 3/2016 | Zeidner et al. | |
| 2016/0242573 | A1 | 8/2016 | Colelman | |
| 2017/0291555 | A1 | 4/2017 | Keezer | |
| 2017/0196355 | A1 | 7/2017 | Hardy et al. | |
| 2017/0258248 | A1 | 9/2017 | Walker | |
| 2017/0318985 | A1 | 11/2017 | Collette | |
| 2018/0020830 | A1 | 1/2018 | Leinonen et al. | |

FOREIGN PATENT DOCUMENTS

| | | |
|---|---|---|
| CN | 3292377 D | 5/2003 |
| CN | 3292378 D | 5/2003 |
| CN | 3292379 D | 5/2003 |
| CN | 3323544 D | 9/2003 |
| CN | 2588875 Y | 12/2003 |
| DE | 40210086-0001 | 5/2003 |
| DE | 40210086-0002 | 5/2003 |
| DE | 40210086-0005 | 5/2003 |
| JP | 2015-128559 A | 7/2015 |
| TW | D133117 | 1/2010 |
| TW | M450299 U | 4/2013 |

OTHER PUBLICATIONS

Declaration of Shane Obitts (with exhibits), Case No. 17-cv-04915-JNE-TNL, dated Nov. 17, 2017, pp. 1-10.

Exhibits 1-7 from Videotaped Deposition of Ronald Kemnitzer in Case No. 17-cv-04915-JNE-TNL, Nov. 14, 2017.

Declaration of Rob Naumoski in Support of General Mills, Inc. and General Mills Sales, Inc.'s Memorandum (with exhibits), Case No. 17-cv-04915-JNE-TNL, dated Nov. 16, 2017, pp. 1-16.

Affidavit of Richard Nathan in Support of General Mills, Inc. and General Mills Sales, Inc.'s Brief (with exhibits), Case No. 17-cv-04915-JNE-TNL, 2017, pp. 1-33.

Defendants' Opposition to Plaintiff's Motion for Preliminary Injunction, Case No. 17-cv-04915-JNE-TNL, dated Nov. 17, 2017, pp. 1-75.

Office Action for U.S. Appl. 29/635,169 dated Mar. 26, 2018.

Collette, et al., "Associated Food Trapezoid Merchandising Test", Exhibit R in Case No. 17-cv-04915-JNE-TNL, Apr. 2015, 3 pages.

Complaint, Case No. 17-cv-04915-JNE-SER, dated Sep. 26, 2017, pp. 1-20.

Declaration of Jesse R. Garcia (with exhibits), Case No. 17-cv-04915-JNE-SER, dated Sep. 27, 2017, pp. 1-148.

Declaration of Ronald Kemnitzer (with exhibits), Case No. 17-cv-04915-JNE-SER, dated Sep. 27, 2017, pp. 1-379.

Defendants' Amended Answer, Separate Defenses, and Counterclaims to Plaintiff's Complaint for Patent Infringement, Case No. 17-cv-04915-JNE-TNL, dated Apr. 13, 2018, pp. 1-14.

Defendants' Answer, Separate Defenses, and Counterclaims to Plaintiff's Complaint for Patent Infringement, Case No. 17-cv-04915-JNE-TNL, dated Nov. 11, 2017, pp. 1-14.

(56) References Cited

OTHER PUBLICATIONS

Expert Report of Paul Hatch, Exhibit A in Case No. 17-cv-04915-JNE-TNL, dated Nov. 11, 2017, pp. 1-133.
First Amended Complaint, Case No. 17-cv-04915-JNE-TNL, dated Mar. 30, 2018, pp. 1-24.
Hearing on Post's Motion for Preliminary Injunction, Powerpoint Presentation Final, Case No. 17-cv-04918, dated Dec. 1, 2017, pp. 1-34.
Hearing on Post's Motion for Preliminary Injunction, Powerpoint Presentation, Case No. 17-cv-04918, dated Dec. 1, 2017, pp. 1-43.
Memorandum in Support of Plaintiff's Motion for Preliminary Injunction, Case No. 17-cv-04915-JNE-SER, dated Sep. 27, 2017, pp. 1-43.
Plaintiff Post Consumer Brands, LLC's Answer to Defendants Amended Counterclaims, Case No. 17-cv-04915-JNE-TNL, dated Apr. 27, 2018, pp. 1-5.
Post's Reply in Support of its Motion for Preliminary Injunction, Case No. 17-cv-04915-JNE-TNL, dated Nov. 27, 2017, pp. 1-38.
Supplemental Expert Report of Paul Hatch, Case No. 17-cv-04915-JNE-TNL, dated Nov. 30, 2017, pp. 1-14.
Transcript of Preliminary Injunction Hearing, Case No. 17-cv-04915-JNE-TNL, dated Dec. 1, 2017, pp. 1-53.
Transcript of Video Deposition of General Mills, Inc., Genral Mills Sales, Inc., and Paul D. Hatch Exhibit PP in Case No. 17-cv-04915-JNE-TNL, Nov. 22, 2017, 211 pages.
Transcript of Videotaped Deposition of Ronald Kemnitzer, Exhibit GG in Case No. 17-cv-04915-JNE-TNL, Nov. 14, 2017, 124 pages.
Declaration of Huijie Shao in Support of Defendants' Opposition to Plaintiffs' Motion for Preliminary Injunction (with exhibits), Case No. 17-cv-04915-JNE-TNL, dated Nov. 17, 2017, pp. 1-127.
Declaration of Stephanie Nelson in Support of General Mills, Inc. and General Mills Sales, Inc.'s Opposition to Plantiff's Preliminary Injunction (with exhibits), Case No. 17-cv-04915-JNE-TNL, dated Nov. 17, 2017, pp. 1-202.
Declaration of Yun (Louise) Lu in Support of Defendants' Opposition to Plaintiffs' Motion for Preliminary Injunction (with exhibits), Case No. 17-cv-04915-JNE-TNL, dated Nov. 16, 2017, pp. 1-92.
Defendants' Preliminary Invalidity Contentions, Case No. 17-cv-04915-JNE-TNL, dated Nov. 8, 2017, pp. 1-22.
Defendants' Preliminary Non-Infringement Contentions, Case No. 17-cv-04915-JNE-TNL, dated Nov. 8, 2017, pp. 1-13.
Memorandum re Post Consumer Brands, LLC motion for preliminary injunction and memorandum to unseal motion, United States District Court of Minnesota, Case No. 17-cv-04915-JNE-TNL, dated Dec. 7, 2017, pp. 1-13.
Design U.S. Appl. No. 29/617,480, filed Sep. 14, 2017.

* cited by examiner

SHELF PARTITION FOR DISPLAYING BAGGED FOOD ITEMS AND METHOD OF USING THE SAME

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

The present invention pertains generally to shelf partitions for displaying bagged food items. More particularly, the present invention pertains to an L-shaped adjustable shelf partition that also serves as an advertisement fixture.

General Background

It is becoming increasing common to package and sell particular bulk food items in plastic bags. For example, many breakfast cereals are now sold in bags rather than boxes. Other bulk food items are also sold in bags (e.g., rice). It should be appreciated that such bags of packaged food products are pliable and deformable, albeit they maintain substantial constant volume. In general, it is impractical to arrange bagged food items on a point-of-sale shelf in a manner such that particular printing on the bags face store patrons. Thus, it can be difficult for patrons to quickly discern what brand of product is provided in the bags. It is therefore common to mount partitions/dividers on shelves to separate and isolate different brands and/or sizes of bagged food items in partitioned compartments and to put other signage near each partitioned compartment for the purpose of identifying and advertisement the bagged food items. In some cases, such signage is attached to or provided on the partitions themselves. The present invention improves upon known prior art shelf partitions for bags of bulk food.

SUMMARY OF THE INVENTION

In a first aspect of the invention, a shelf partition for containing and displaying bagged bulk food on point-of-sale shelving comprises a front panel and an adjustable length side panel. The front panel comprises at least a translucent front portion. The translucent front portion has a convex outer face. The front portion of the front panel is configured and adapted to magnify a flat image when the flat image is positioned behind the front portion of the front panel. The adjustable length side panel is connected to the front panel.

In another aspect of the invention, a shelf partition for containing and displaying bagged bulk food on point-of-sale shelving comprises a front panel and an adjustable length side panel. The adjustable length side panel is connected to the front panel. At least a first portion of the front panel and at least a first portion of the side panel are integrally formed as a monolithic and homogenous injection molded piece, the shelf partition has an L-shape in plan view.

In yet another aspect of the invention, a method of displaying bagged bulk food on point-of-sale shelving comprises attaching a first shelf partition to a point-of-sale shelf. The shelf has a front edge and a back edge. The first shelf partition comprises a front panel and an adjustable length side panel. The adjustable length side panel is connected to the front panel and at least a first portion of the front panel and at least a first portion of the side panel are integrally formed as a monolithic and homogenous injection molded piece. The first shelf partition has an L-shape in plan view. The front panel is placed adjacent to the front edge of the shelf. The side panel has a rear end that is adjacent to the back edge of the shelf. The method also comprises attaching a second shelf partition to the shelf. The second shelf partition is identical to the first shelf partition and comprises a front panel and an adjustable length side panel. The front panel of the second shelf partition is adjacent to the rear edge of the shelf. The side panel of the second shelf partition has a rear end that is adjacent to the front edge of the shelf. The front panels of the first and second shelf partitions are positioned between the side panels of the first and second shelf partitions. The method further comprises placing bagged bulk food on the shelf between the side panels of the first and second shelf partitions and partially behind the front panel of the first shelf partition.

Further features and advantages of the present invention, as well as the operation of the invention, are described in detail below with reference to the accompanying drawings.

Figure 1:
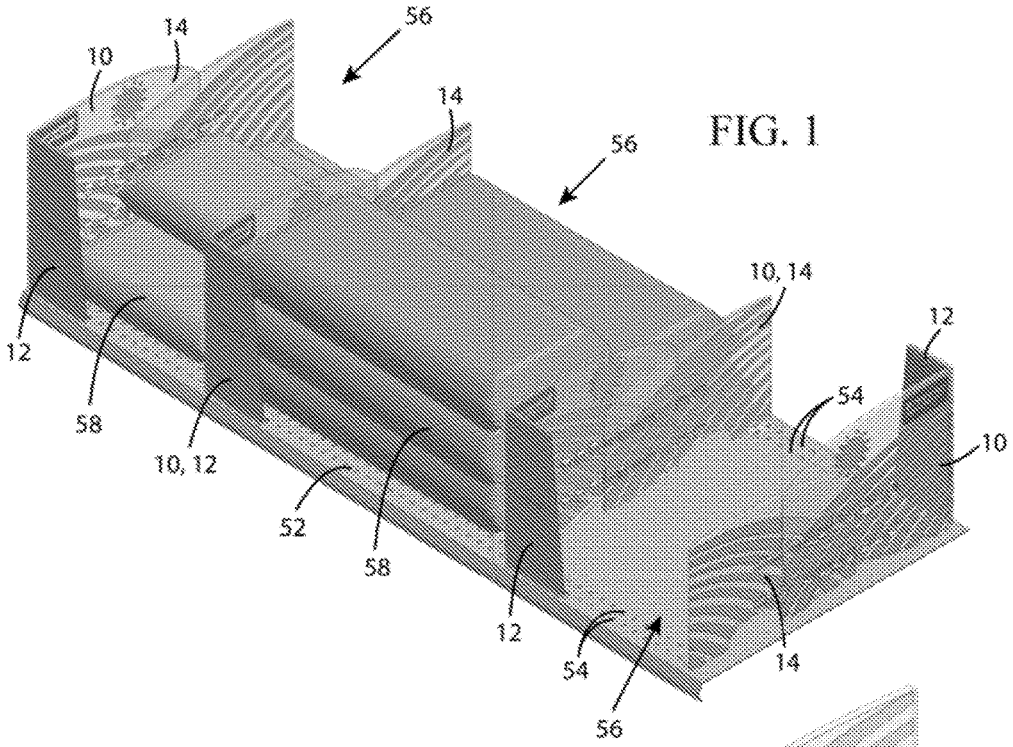
FIG. 1 depicts a perspective view of a plurality of shelf partitions in accordance with the invention attached to a point-of-sale shelf with bagged bulk food packages placed on the self therebetween.

Reference numerals in the written specification and in the drawing figures indicate corresponding items.

DETAILED DESCRIPTION

Figure 2:
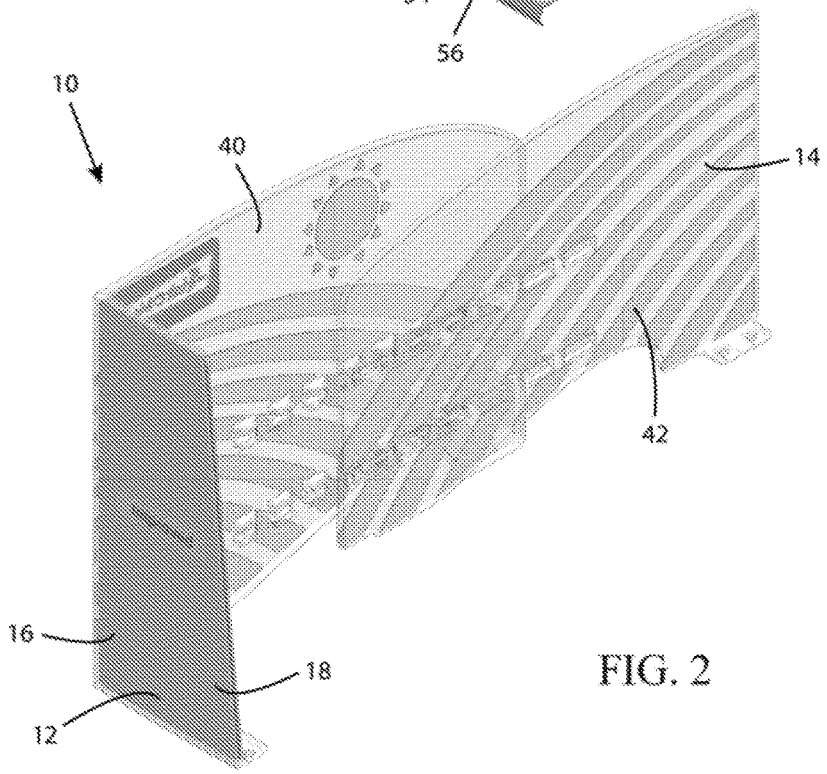
FIG. 2 depicts a perspective view of one of the shelf partitions, with the side panel of the shelf partition in an extended configuration.
Figure 3:
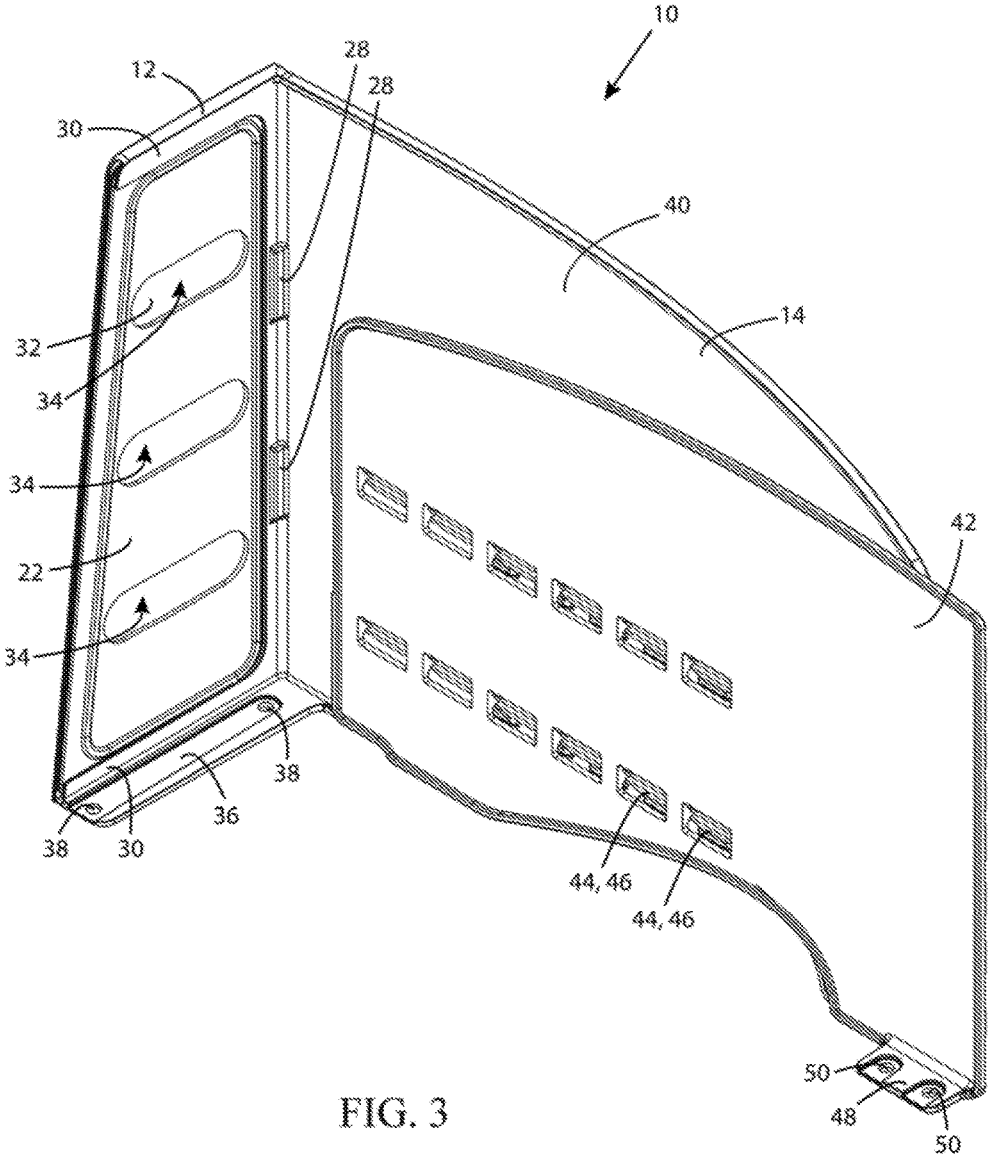
FIG. 3 depicts another perspective view of one of the shelf partitions, with the side panel of the shelf partition in an un-extended configuration.
Figure 4:
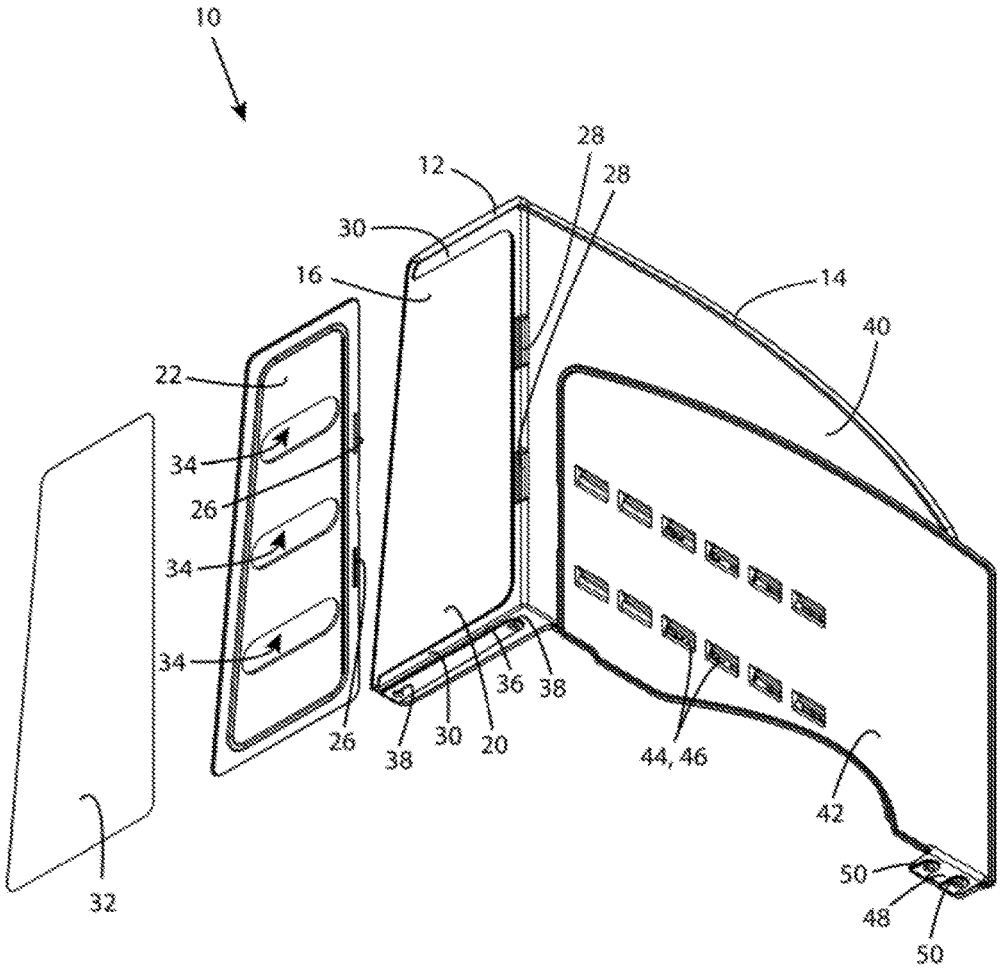
FIG. 4 depicts an exploded perspective view of the shelf partition as shown in FIG. 3, except with the support wall of its front panel and product advertisement shown detached from the shelf partition.
Figure 5:
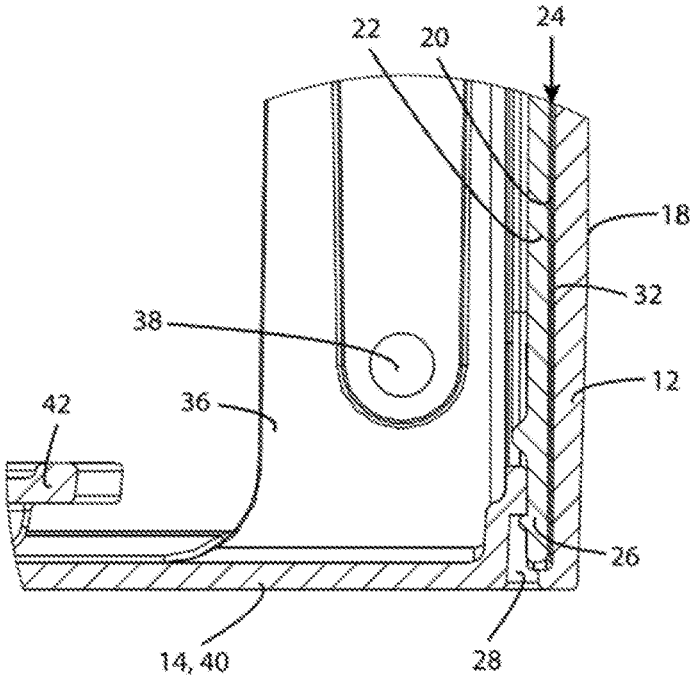
FIG. 5 depicts a detail horizontal cross-section of the shelf partition taken about a horizontal plane that intersects one of the locking formations of the support wall of the shelf partition.
Figure 6:
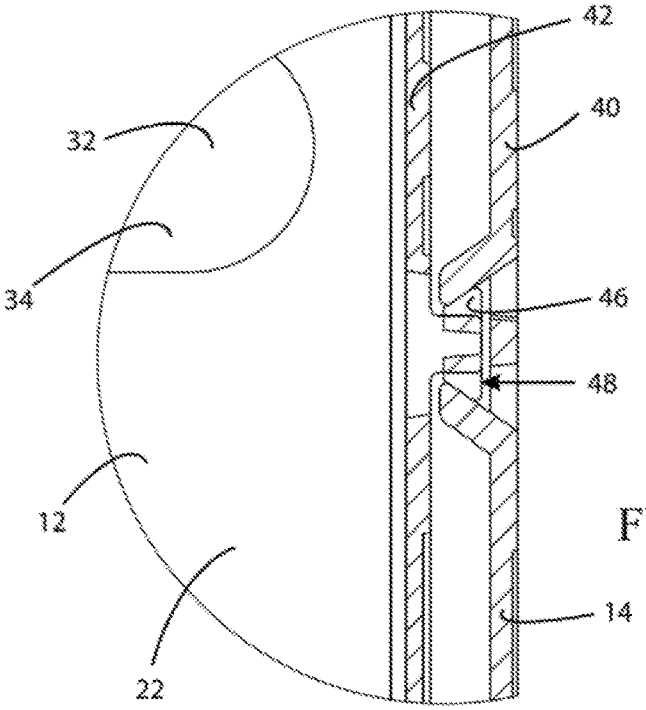
FIG. 6 depicts a detail vertical cross-section of the side panel of the shelf partition showing one set of the interlocking formations between the first and second portions of the side panel.

An embodiment of a shelf partition (10) for separating and displaying bagged bulk food on point-of-sale shelving in accordance with the invention is shown in FIGS. 2-4. The shelf partition (10) comprises a front panel (12) and an adjustable length side panel (14). The front panel (12) and the side panel (14) are connected to each other in a manner such that the shelf partition (10) is L-shaped in plan view (i.e., when viewed from directly above).

The front panel (12) comprises a translucent (and preferably transparent) front portion (16) that has a slightly convex outer surface (18). The back (20) of the front portion (16) is preferably flat. As such, the front portion (16) of the front panel (12) is configured to magnify what is behind the front portion of the front panel. The front panel (12) also comprises a support wall member (22) that that is spaced behind the front portion (16) of the front panel in a manner forming a pocket (24) between the front portion and the support wall member. The support wall member (22) is preferably formed separate from the remainder of the front panel (12) but is preferably configured to interlock with the remainder of the front panel via tabs (26) and slots (28). Once secured to the remainder of the front panel (12) via the tabs (26) and slots (28), the support wall member (22) is held generally parallel to the front portion (12) of the front panel by rails (30) that extend horizontally along the top and bottom of the front portion. The pocket (24) between the front portion (16) and the support wall member (22) of the front panel (12) is open along its rightmost end. As such, an advertisement member (32) can be slid into the pocket (24) where it will visible through the translucent front portion (16) of the front panel (12). The advertisement member (32) may be printed paper, cardboard, or any sheet material. The front portion (16) and support wall member (22) of the front panel (12), and the advertisement member (32) preferably all have generally the same perimeter shape and size. Preferably that perimeter shape is trapezoidal as shown, with horizontal top and bottom edges, a vertical left edge, and a sloped right edge. The support wall member (22) also preferably comprises at least one opening (34) that provides a finger hole to facilitate the removal of the advertisement member (32) from the pocket (24) of the front panel (12). The primary purpose of the of the support wall member (22) is to hold the advertisement member (32) against the front portion (16) of the front panel (12) and to prevent inadvertant removal of the advertisement member from the shelf partition (10) when bagged bulk food packages slide against the back of the front panel. The base of the front panel (12) also preferably comprises a support foot (36) that has a plurality of through-holes (38) that are configured to receive fasteners (not shown) for securing the shelf partition (10) to a point-of-sale shelf, as is explained in greater detail below.

The side panel (14) of the shelf partition (10) preferably comprises first (40) and second (42) portions that are slideably connected to each other in a manner allowing the length (depth) of the side panel to be adjusted prior to attaching the shelf partition to a point-of-sale shelf. The first portion (40) of the side panel (14) is preferably formed integrally with the front portion (16) of the front panel (12) as a monolithic and homogenous injection molded piece of polycarbonate. The second portion (42) of the side panel (14) is preferably interlocked to the first portion (40) of the side panel via a plurality of slots (44) and tabs (46) that prevent relative movement between the first and second portions, except for horizontal relative movement parallel to the length of the side panel. Thus, prior to being fully attached to a shelf, the length/depth of the side panel (14) can be adjusted to match the depth of the shelf. The base of the second portion (42) of the side panel also preferably comprises a support foot (48) having a plurality of through-holes (50) configured to receive fasteners (not shown) for securing the shelf partition (10) to a point-of-sale shelf. As shown in FIGS. 1 and 2, the first (40) and second (42) portions of the side panel (14), preferably have perimeters and textured surfaces that themselves may resemble the trademark(s) associated with the bagged bulk food the shelf partition (10) is configured to separate and display.

In use, shelf partitions (10) configured as described above are attached to a point-of-sale shelf (52) as shown in FIG. 1. This is done be inserting press fittings through the through-holes (38, 50) of the support feet (36, 48) of the front and side panels and into the standard holes (54) typically provided on such a point-of-sale shelf (52). The adjustability of the length of the side panel (14) of each shelf partition (10) allows the shelf partition to be set to the depth of the shelve (52) (which is typically somewhere from fourteen to twenty eight inches). As shown in FIG. 1, the front panels (12) of the shelf partitions (10) are typically oriented facing the side of the shelf that faces a store aisle. However, in situations where it is desired to store/display bagged products adjacent to a right side edge of a shelf (52), the right-most shelf partition (10) can be reversed (i.e., attached to the shelf with the front panel (12) of said shelf partition adjacent the rear of the shelf) such that the side panel (14) of the shelf partition can be in close proximity to the right edge of the shelf (as shown in FIG. 1). As is shown in FIG. 1, the shelf partitions (10) can thereby form partitioned compartments (56) for storing and displaying bags (58) of bulk food or other bagged bulk items. Preferable the shelf partitions (10) are spaced from each other along the shelf (52) in a manner such that bags (58) of bulk food or other items fit snugly between the shelf partitions. As such, the front panels (12) of the shelf partitions (10) help prevent such bags (58) from inadvertently siding off of the shelf (52). When replacing one type of bagged food products (58) with another, the spacing between the shelf partitions (10) can be adjusted (if needed) any relevant advertisement member (32) can easily and quickly be replaced by sliding the advertisement member out of the pocket (24) of the front panel (12).

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit.

What is claimed is:

1. A shelf partition for containing and displaying bagged bulk food on point-of-sale shelving, the shelf partition comprising a front panel and an adjustable length side panel, the adjustable length side panel being connected to the front panel in a manner such that the shelf-partition has an L-shape in plan view, the adjustable length side panel being variable in length between a first length and a second length, the front panel comprising a transparent front portion and a support wall spaced from the front portion, the support wall being generally parallel to the front portion, the front portion and the support wall collectively defining a pocket open on at least one side, the pocket being configured and adapted to receive a product advertisement such that the product advertisement is substantially encased between the front portion and the support wall;

wherein the adjustable length side panel comprises a first side panel portion and a second side panel portion, the second side panel portion being slideably connected to the first side panel portion such that a length of the adjustable length side panel can be adjusted by sliding the second side panel portion horizontally relative to the first side panel portion;

wherein each of the front panel and the second side panel portion comprise a support foot, each support foot having at least one through-hole adapted to receive a fastener such that the shelf partition can be removably secured to point-of-sale shelving; and wherein the transparent front portion of the front panel has a convex outer face, the transparent front portion of the front panel being configured and adapted to magnify a flat image when the flat image is positioned behind the transparent front portion of the front panel.

2. A shelf partition in accordance with claim 1 wherein the support wall comprises at least one finger hole that is configured and adapted to facilitate the removal of said product advertisement from the pocket.

* * * * *